US005927622A

United States Patent [19]

Zoellinger

[11] Patent Number: 5,927,622

[45] Date of Patent: Jul. 27, 1999

[54] WASTE GRINDER AND BIT THEREFORE

[75] Inventor: Frank H. Zoellinger, Greensboro, N.C.

[73] Assignee: Eurohansa, Inc., High Point, N.C.

[21] Appl. No.: 09/182,767

[22] Filed: Oct. 29, 1998

Related U.S. Application Data

[60] Provisional application No. 60/064,821, Nov. 7, 1997.

[51] Int. Cl.[6] ..... B02C 18/18

[52] U.S. Cl. ..... 241/27; 241/28; 241/73; 241/282; 241/293; 241/294; 241/300

[58] Field of Search ..... 241/27, 28, 29, 241/273.1, 279, 280, 281, 282, 293, 294, 300, 73

[56] References Cited

U.S. PATENT DOCUMENTS

| | | | |
|---|---|---|---|
| 3,574,989 | 4/1971 | Rousseau | 56/10.7 |
| 3,635,410 | 1/1972 | Smith | 241/56 |
| 3,759,304 | 9/1973 | Lundmark et al. | 144/180 |
| 3,904,135 | 9/1975 | Bogie | 241/86 |
| 4,074,737 | 2/1978 | Stewart | 241/294 X |
| 4,077,450 | 3/1978 | Ackerman | 144/172 |
| 4,394,983 | 7/1983 | Ulsky | 241/243 |
| 4,455,995 | 6/1984 | Bloomquist | 241/277 |
| 4,669,516 | 6/1987 | Carpenter et al. | 144/241 |
| 4,771,718 | 9/1988 | Carpenter et al. | 144/176 |
| 4,827,989 | 5/1989 | Strong | 144/176 |
| 4,860,961 | 8/1989 | Hilgarth | 241/92 |
| 5,005,620 | 4/1991 | Morey | 144/373 |
| 5,037,248 | 8/1991 | Heffron | 707/12 |
| 5,143,311 | 9/1992 | Laster | 241/280 |
| 5,205,498 | 4/1993 | Ostermeier et al. | 241/55 |
| 5,362,004 | 11/1994 | Bateman | 241/290 |
| 5,390,865 | 2/1995 | Vandermolen et al. | 241/101.7 |
| 5,468,176 | 11/1995 | Udert et al. | 451/359 |
| 5,649,578 | 7/1997 | Leguin | 144/176 |
| 5,785,263 | 7/1998 | Wu et al. | 241/79.1 |
| 5,860,609 | 1/1999 | Sommer et al. | 241/293 |

*Primary Examiner*—John M. Husar
*Attorney, Agent, or Firm*—Dougherty & Associates

[57] ABSTRACT

The present invention is an apparatus and a method of operating a grinder for chipping and shredding material into waste, the grinder including a generally cylindrical drum having an exterior surface with a plurality of pockets formed into the exterior surface. Within each pocket, at least one of a plurality of bits are removably positioned, with each bit having a base securable into the pocket providing an upper cutting edge portion of each bit that extends above the exterior surface. Each upper cutting edge extends outward in an arcuate curving shape from each side of the bit, forming a self-sharpening sharp outer edge for each side of the bit. Each pocket and removable bit has a center line that may be angled off-set with respect to a center line of the radius of the rotor drum, providing protrusion of the leading cutting edge of each bit above the exterior surface so that the leading cutting edges of the plurality of bits are placed in contact with the material to be chipped and shredded. The apparatus and method of operation provides an improved grinder having bits with a self-sharpening cutting edge feature for increased efficiency for chipping and shredding material into waste. The self-sharpening cutting edge bits reduce the energy requirements of the drum, reduce the noise levels of the operating drum, and reduce maintenance costs while extending the life of each cutting bit.

18 Claims, 3 Drawing Sheets

WASTE GRINDER AND BIT THEREFORE

CROSS REFERENCE TO RELATED APPLICATIONS

This application claims the priority benefit of United States Provisional Patent Application Ser. No. 60/064,821, filed Nov. 7, 1997.

FIELD OF THE INVENTION

The present invention relates to rotary drum grinders for producing chips from waste material. More particularly, the present invention relates to a grinder having a rotary drum with concave-wall cutting bits for producing chips from waste materials.

BACKGROUND

Cylindrical drum-type wood chippers, metal and plastic grinders reduce waste into chips or shards for recycling of materials. Drum-type wood chippers generally include a rotating cylindrical drum or rotor having an exterior surface studded with bits. Existing bits function as either hammers or knife blades depending upon, among other things, the consistency of the waste and the desired consistency of the output chips. For example, knife blades are used to produce neatly cut chips from waste having a relatively low density. Hammers, on the other hand, are used to pulverize, shred, and tear relatively dense waste into randomly shaped shards.

Existing bits are welded or bolted to the exterior surface of the drum. Although the bits can be positioned in any one of a virtually limitless number of patterns on the exterior surface of the drum, bits are generally either positioned in a screw pattern or a "V" pattern. Existing bits or hammers generally have a rectangular shape and are formed of a single piece of hardened steel. The front upper edge of the existing bits or hammer are worn from contact with the waste. When the front upper edge becomes excessively worn, the bits or hammer are replaced or repositioned so that another cutting edge is moved to the front position. The waste processing industry is extremely cost conscious. Therefore, longer wearing cutting bits are extremely important to the operators of chipping and grinding machines. The invented cutting bit apparatus and method of operation provides a cutting bit that has demonstrated a longer life for the cutting edge of the drill bit, therefore providing a significantly longer life of the cutting bit without significant additional cost for each cutting bit.

SUMMARY OF THE INVENTION

The present invention is a drum-type grinder for reducing waste into convenient-sized pieces. The invented grinder includes a rotatable drum positioned in a chipping chamber and a plurality of bits secured to the drum for engaging waste. While existing grinders are limited in the variety of material which they can handle, the invented grinder is useful for reducing wood as well as other materials, such as aluminum, plastics, cardboard, hardened rubber, and other hardened materials, into small pieces.

In a preferred embodiment, the invented grinder includes a plurality of pockets formed in the exterior surface of the drum. The pockets are generally rectangular in shape and receive bits which are preferably each formed from machine tool steel. It has been found that a machine tool steel known as "S-7" is an adequate material for the bits, and other hardened materials may be utilized in addition to S-7 steel. When properly heat treated and double tempered, the steel has a hardness of approximately 59 (as measured on the Rockwell "C" scale) and develops a special type of "toughness" in addition to hardness. Unlike other types of tool steels, any type of heat tempered steel is very shock resistant and stays somewhat flexible while maintaining its wear resistance under strong impact. As a consequence, the invented bit is relatively resistant to breaking and chipping and has a self-sharpening cutting edge.

The bits have an upper portion extending from the base. A concave channel is formed by machining in the exterior surface of the upper portion of the bit. The invented concave channeled bit has numerous advantages over existing bits.

First, the invented bit combines the advantages of both knives and hammers. The invented bit provides a sharp surface necessary to cut into material like a knife and has the bulk of a hammer to perform the pulverizing and shredding function of a hammer. Consequently, the cutting advantage of knives is combined with the power of hammers.

Second, the invented bit is self-sharpening. As a result of the improved shape of the bit, wear of the front upper edge of the bit does not decrease its sharpness.

Third, the channel in the exterior wall of the upper portion of the bit helps remove cut material sideways away from the upper surface of the bit so that pieces of waste are not dragged past the anvil located in close proximity to the rotatable drum. As a consequence, approximately one third less power is required to operate the invented grinder with improved bits. The invented bit also operates at a significantly lower noise level, which benefits the operator's of the machine and allows the company owning or operating the machine to meet occupational safety and health standards for the country or state where the machine is operating.

A bit is positioned in each of the pockets. Each bit has a generally square or rectangular base which forms an interference fit with at least two of the pocket walls. Each bit also has a bore formed through the center of the bit body which provide a means for inserting a screw to secure the bit to the drum.

Preferably, the bottom surface of each pocket is angled such that when the base of a bit is positioned in a pocket, the upper portion of the bit is positioned off-set with the radius of the drum. Preferably, the center line of the tool bit is on a line parallel to the radius of the drum and is positioned towards the direction of drum rotation. Consequently, the front upper cutting edge of the bit moves relatively close to the anvil as it rotates past the anvil while the rear upper edge moves relative far away from the anvil as it rotates past the anvil after the front upper edge rotates past the anvil. This added space between the trailing portion of the bit and the anvil enables pieces of waste to be pushed into the screen portion of the chipping chamber without the bit dragging the pieces of waste past the anvil. As a result, the cutting bits and rotor drum on the invented grinder requires less power than existing grinders to reduce the same waste material.

In operation, the drum is positioned in a chipping chamber. Waste is inserted into a hopper having an entrance into the chipping chamber. A feed mechanism delivers the waste toward engagement with the exterior surface of the rotating drum. As the waste reaches an anvil, which is typically positioned at the end of the feed mechanism, the plurality of bits on the exterior surface of the drum and the anvil begin reducing the waste. Rotation of the drum forces pieces of the waste into a screened portion of the chipping chamber beginning at the anvil. A screen enclosing the screened portions has variable sized openings depending on the desired size of the output chips or shards. While the pieces of waste are in the screened portion of the chipping chamber, the cutting bits on the exterior surface of the drum and the screen further reduce the size of the waste. Sufficiently reduced waste is then forced through the openings in the screen and removed from the chipping chamber. Waste which is not forced through the screen exits from the chipping chamber and moves back into the hopper from where it is again returned into the chipping chamber for additional size reduction.

OBJECTS OF THE INVENTION

The principal object of the present invention is to provide an improved drum-type grinder having a plurality of bits that efficiently reduce waste material into small pieces.

Another object of the invention is to provide a cutting bit that reduces the power requirements of a drum-type grinder.

A further object of this invention is to provide a cutting bit that remains sharp during continued operation thereby increasing the operating life of the tool bit and reducing grinder operating costs.

Another object of the present invention is to provide an improved drum-type grinder that has a plurality of bits which can handle a wide variety of waste material including materials other than wood.

A further and more particular object of the invention is to provide an improved drum-type grinder having a plurality of bits which operate at a lower noise level than the existing equipment utilized for cutting and grinding waste.

The objects of the invention are met by an apparatus including a grinder for chipping and shredding material into size reduced waste, the grinder comprising a generally cylindrical rotatable drum having an exterior surface; the exterior surface having a plurality of pockets formed into the surface, each pocket having a base formed by a recess in the exterior surface. Within each recess, one of a plurality of bits is removably positioned in each of the plurality of pockets with each bit removably attached to the recess base, with the plurality of bits having a base securable to the recess base, providing an upper portion of each bit to extend from the exterior surface of the drum. Each bit has an upper portion extending outward from each side of the bit, each side of each bit having a concave channel formed in the exterior side surface of the upper portion of each bit side, the upper portion forming a sharp edge for each side, the sharp edges opposite the base of each bit. Each pocket recess is angled off-set with respect to the radius of the rotatable drum, providing the leading sharp edges of each concave channel of each bit to protrude above the exterior surface of the drum so that the leading sharp edges are placed in contact with the material to be chipped and shredded.

The objects of the invention are also met by a method for chipping and shredding material into waste, including the steps of providing a generally cylindrical drum having an exterior surface with a plurality of pockets formed into the surface, with each recess having a plurality of bits removably positioned in the plurality of pockets. The rotatable drum is rotated allowing an upper sharp edge portion of each bit to contact the material to be chipped and shredded.

The apparatus and method of operation described herein meet the objects of the invention and provides an improved grinder for chipping and shredding material into waste.

BRIEF DESCRIPTION OF THE DRAWINGS

In view of these and other objects which will be more readily apparent as the nature of the invention is better understood, the invention consists in the novel combination and arrangement of parts hereinafter more fully described, illustrated and claimed with reference being made to the attached drawings, in which:

DETAILED DESCRIPTION

Figure 1:
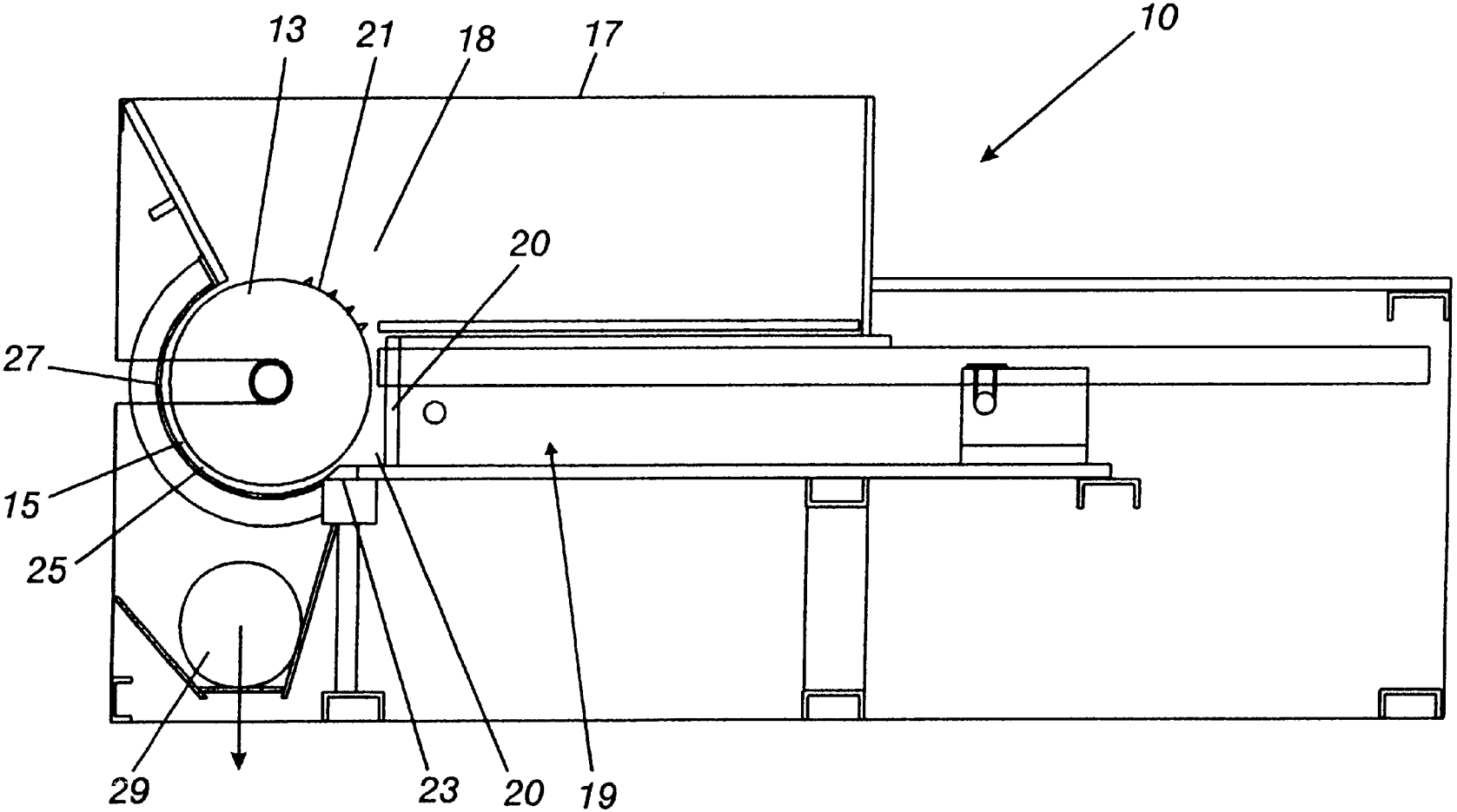
FIG. 1 is a cross-sectional view of a drum-type grinder according to the present invention.

Referring now to the drawings, and particularly to FIG. 1, the invented drum-type grinder and bit, referred to generally as 10, the grinder having wall enclosures that house a rotatable drum 13 and an interior chipping chamber 15, into which material to be chipped and shredded is placed. The chipping chamber 15 has the rotatable drum 13 positioned in one end or a lower area of the chipping chamber 15. The drum 13 is driven by a motor (not shown) which rotates the drum 13 in a desired direction. Waste is inserted into a hopper 17 having an entrance 18 into the chipping chamber 15. A feed mechanism 19 delivers the waste toward engagement with the exterior surface 21 of the drum 13. As the waste reaches an anvil 23, which is typically positioned at the chipping and shredding end 20 of the feed mechanism 19, the bits 101, 201, 251, 271, 301 (not shown in FIG. 1, see FIG. 2–9) on the exterior surface 21 of the drum 13 cut and drive the waste material against the anvil 23 to reduce the waste to pieces. Rotation of the drum 13 forces pieces of the waste into a screened portion 25 of the chipping chamber 15 beginning at the anvil 23. The screened portion 25 extends around and partially encircles the exterior surface 21 as the exterior surface 21 is rotated in a direction from the anvil 23 through the chipping chamber 15 to the hopper 17. A screen 27 enclosing the screened portion 25 has variable sized openings depending on the desired size of the output chips or shards allowed to escape through the screen 27. The screen 27 does not enclose the area open to the hopper 17 that is distinguished as the entrance 18 (see FIG.1). While the pieces of waste are in the screened portion 25 of the chipping chamber 15, the bits 101, 201, 251, 271, 301 on the exterior surface 21 of the rotor drum 13 provide repetitive chipping and shredding on the waste held within the screened portion 25 due to the variable sized openings of the screen 27, further reducing the size of the waste material. Sufficiently reduced waste is then forced through the openings in the screen 27 and removed from the chipping chamber 15 through opening 29. Waste which is not forced through the screen 27 exits from the chipping chamber 15 and moves back into the hopper 17 from where it is again returned into the chipping chamber 15 for repetitive contact with the bits 101, 201, 251, 271, 301.

Figure 2:
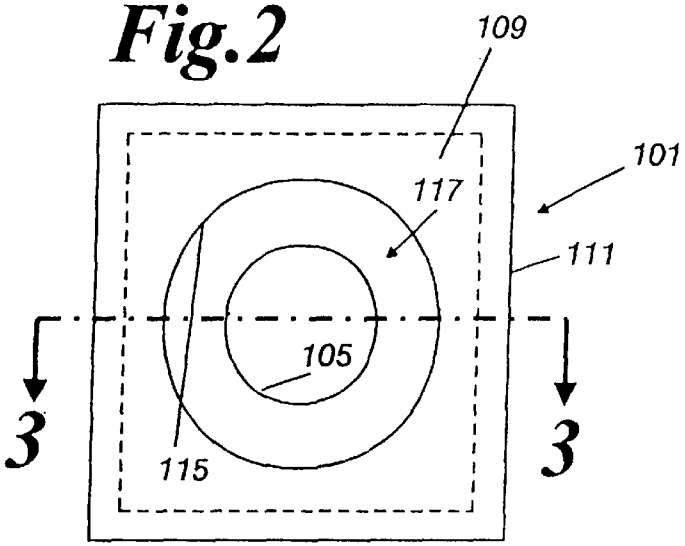
FIG. 2 is a top view of a concave-type cutting bit according to the present invention.
Figure 3:
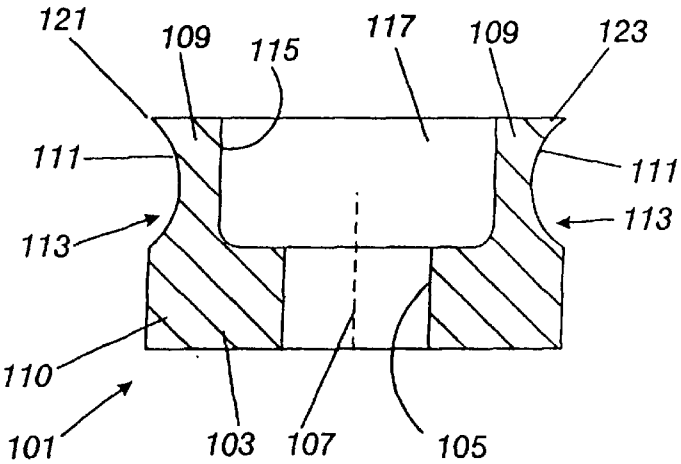
FIG. 3 is a cross-sectional side view of the cutting bit of FIG. 2 taken along line 3—3.

As shown in FIG. 2 and FIG. 3, one embodiment of the tool bit 101 has a generally square or rectangular base 103 and a generally circular bore 105 through a center axis 107 of the base 103. The base 103 may have a width of two inches or wider. The upper wall portion 109 of the bit 101 extends in an arcuate shape from the base 103. A concave channel 111 forms the arcuate shape in the exterior surface 113 of the upper wall portion 109 of the bit 101. A leading cutting edge 121 and a trailing cutting edge 123, is formed by the top area of the upper wall portion 109. Either leading cutting edge 121 or trailing cutting edge 123 may serve as the leading point of chipping and shredding, depending on the direction of rotation of the exterior surface 21 of the drum 13.

As shown in FIG. 2, an interior cavity 115 is formed in a central region 117 of the upper wall portion 109 of the bit 101. The base 103 of the bit 101 may have a shape other than rectangular, such as a polygon having five, six or more sides, or a square having curved sides, or a trapezoid shape, as long as the base fits securely on the exterior surface 21, or fits into the pockets or depressions in the exterior surface 21, to deter the detachment of the bits 101, 201, 251, 271, 301 from the exterior surface 21 during operations at high speeds of rotation of the rotor drum 13.

ALTERNATIVE EMBODIMENTS

Figure 4:
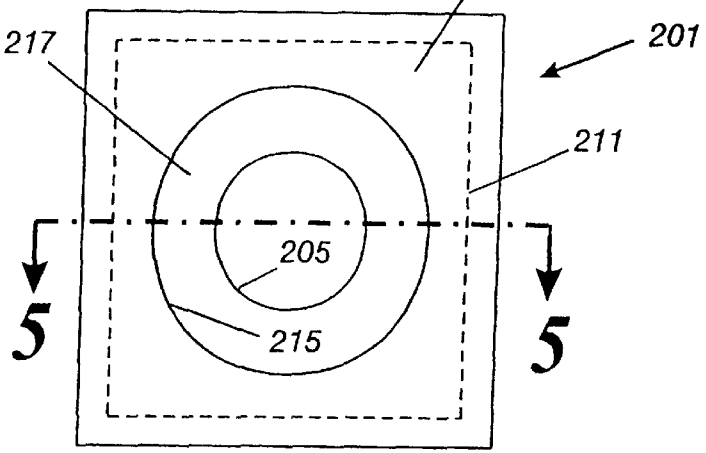
FIG. 4 is a top view of an alternative concave-type cutting bit according to the present invention.
Figure 5:
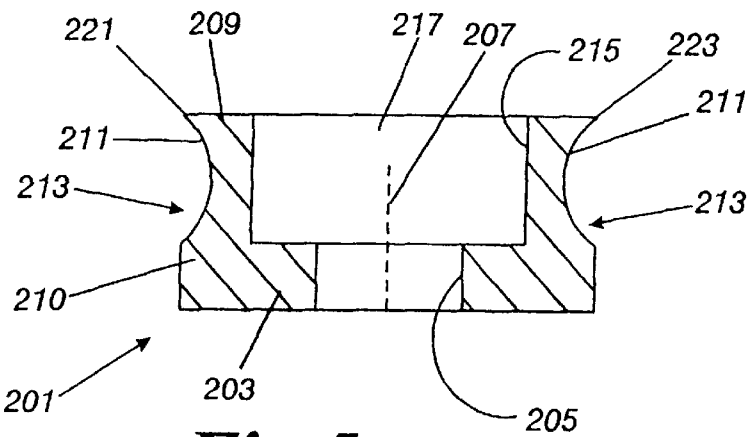
FIG. 5 is a cross-sectional side view of the cutting bit of FIG. 4 taken along line 5—5.

As shown in FIG. 4 and FIG. 5, another embodiment of the tool bit 201 has a generally square, rectangular, or multi-sided base 203 and a generally circular bore 205 through a center 207 of the base 203. The upper portion 209 of the bit 201 extends from the base 203. A concave channel 211 is formed in the arcuate exterior surface 213 of the upper wall portion 209 of the bit 201. The lower wall portion 210 of the bit 201 may extend generally vertical in orientation to the base 203.

A cavity 215 is formed in a central region 217 of the upper portion 209 of the bit 201. Tool bit 201 is sized smaller overall that tool bit 101, and is useful for applications requiring relatively smaller tool bits. Tool bit 201 may have a base 203 width of one and three quarter to one and seven eighth inches or less.

A leading cutting edge 221 and a trailing cutting edge 223, is formed by the top area of the upper wall portion 209. Either leading cutting edge 221 or trailing cutting edge 223 may serve as the leading point of chipping and shredding, depending on the direction of rotation of the exterior surface 21 of the drum 13.

Figure 6:
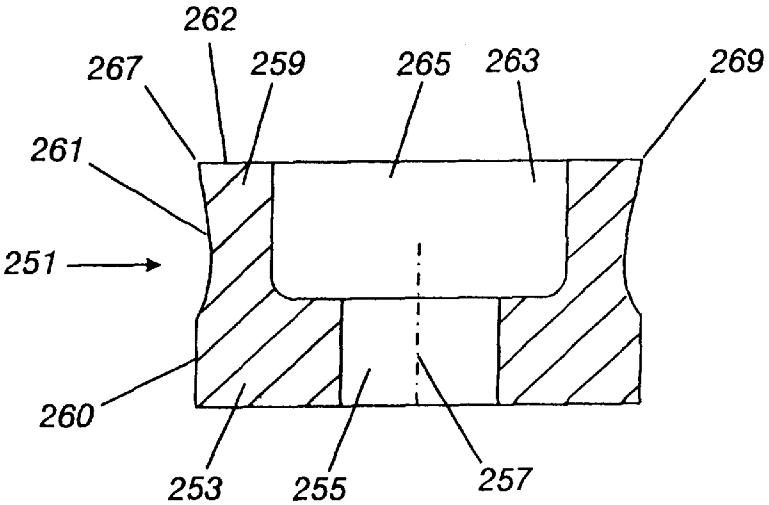
FIG. 6 is a cross-sectional side view of a curved side wall cutting bit according to the present invention.

An additional embodiment in the form of an curved-wall type bit 251 is shown in FIG. 6. The bit 251 has a generally five, six, or more sided base 253 and a generally circular bore 255 through a center 257 of the base 253. The upper wall portion 259 of the bit 251 extends from the base 253. The base width may have a range of approximately 1¾ to 1⅞ inches or less, or two inches or greater. The exterior surface 261 of the upper wall portion 259 of the bit 251 is curved upward and outward from the base 253 to a top 262 of said upper wall portion 259. A cavity 263 is formed in a central region 265 of the upper portion 259 of the bit 251. The upper wall portion 259 may have five, six, or more sides, as may the base 253, coinciding with the number of sides of the upper wall portion 259.

A lower wall portion 260, may extend generally vertical in orientation to the base 253. A leading cutting edge 267 and a trailing cutting edge 269, is formed by the top area of the upper wall portion 259. Either leading cutting edge 267 or trailing cutting edge 269 may serve as the leading point of chipping and shredding, depending on the direction of rotation of the exterior surface 21 of the drum 13.

Figure 7:
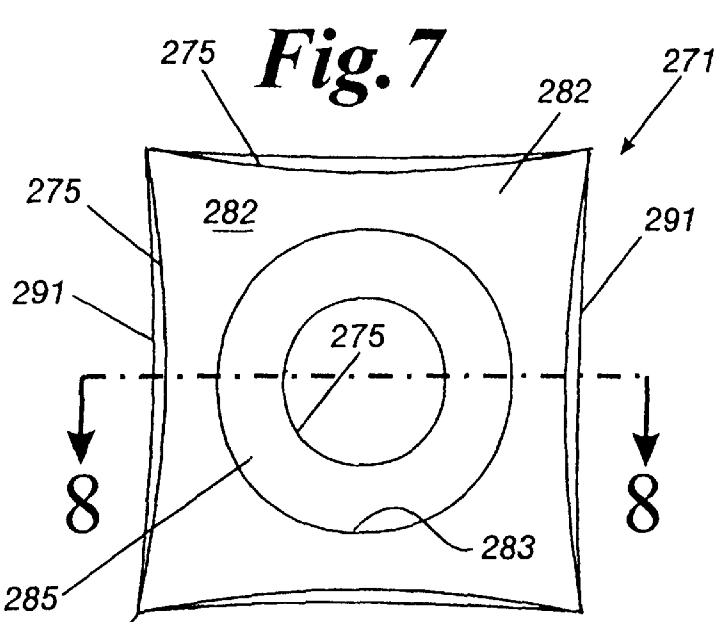
FIG. 7 is a top view of an alternative base having inwardly concave upper edges of the cutting bit according to the invention.
Figure 8:
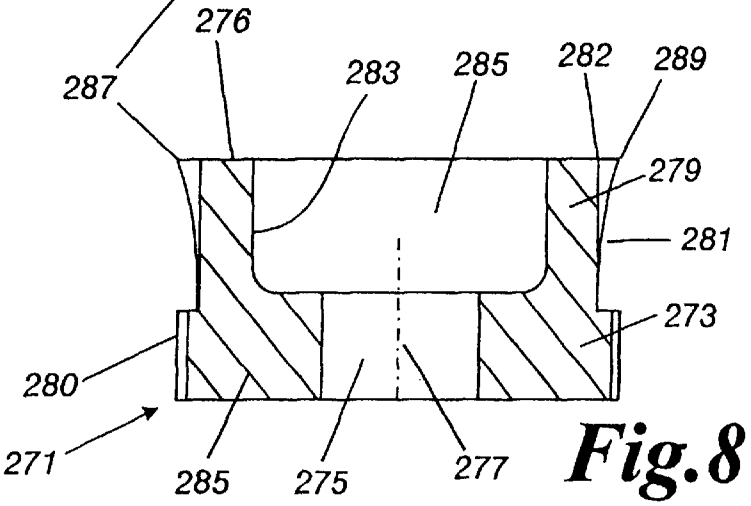
FIG. 8 is a cross-sectional side view of the cutting bit of FIG. 7 taken along line 8—8.

An additional embodiment in the form of a base having inwardly concave sides of the bit 271 is shown in FIG. 7 and FIG. 8. The bit 271 has a generally polygon base 273 and a generally circular bore 275 through a center 277 of the base 273. The upper wall portion 279 of the bit 271 extends from the base 273. The exterior surface 281 of the upper wall portion 279 of the bit 271 is an arcuate curve (see FIGS. 3, 5, 6, and 8), from the base 273 to a top 282 of said upper wall portion 279. The exterior, curved upwards surface 281 may have a inwardly concave curve 275 across the width of the surface 281. Looking down on the bit 271 as shown in FIG. 7, an operator will see a star-shape of the curvature 291 of the base, and the greater inwardly concave curve 275 of the upper exterior surface 281. A cylindrical recess 283 is formed in a central region 285 of the upper portion 279 of the bit 271.

A lower wall portion 280, may extend generally vertical in orientation to the base 273. The lower wall portion 280 may have sides that curve inwardly 291 to form a multi-sided base with each upright wall having a slight concave curvature 291 inward toward the center of the base. A leading cutting edge 287 and a trailing cutting edge 289, is formed by the top area of the upper wall portion 279. Either leading cutting edge 287 or trailing cutting edge 289 may serve as the leading point of chipping and shredding, depending on the direction of rotation of the exterior surface 21 of the drum 13.

Figure 9:
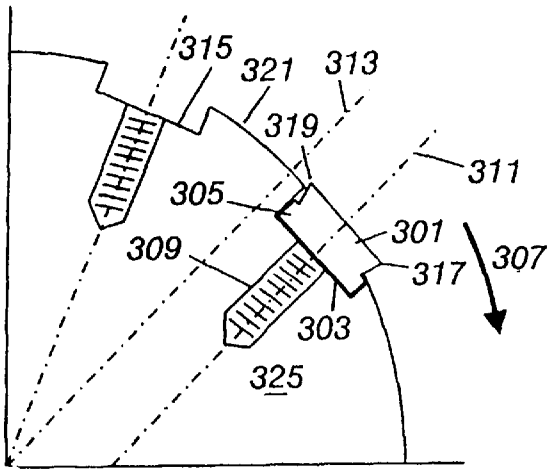
FIG. 9 is a cross-sectional side view of the cutting bit of FIG. 5 positioned in a pocket in the exterior surface of a drum.

As shown in FIG. 9, the curved-wall type tool bit 301 may be positioned in an angled pocket 303 or generally square or rectangular depression in the exterior surface 321 of a rotor drum 325. The base 305 of bit 301 is positioned in the pocket 303. The base 305 may be generally rectangular or polygon in shape, with the angled pocket 303 having a shape to allow positioning of the base 305 of bit 301 into the pocket 303 so that the bit will not rotate within the pocket when pressure is applied on the bit 301 from the material to be ground. A screw 309 or other connector is used to secure the bit 301 in the pocket 303. The center line 311 of the tool bit 301 is parallel to the radius 313 of the rotor drum 325 and is positioned off-center by approximately a five to eight degree (5°–8°) angle from the centered diameter of the drum in the general direction of drum 325 rotation 307. A standard non-angled pocket 315 is shown for comparison. Rotor drums 325 are approximately ten (10) inches in diameter up to approximately twenty eight (28) inches in diameter may be manufactured to accommodate the tool bits 301.

The front upper or leading edge 317 of the bit 301 extends radially outward further than the rear upper edge 319 of the bit 301. The curved leading edge 317 and curved wall of the leading edge may be one hundred percent (100%) exposed above the rotor drum 325. The rear upper edge 319 and rear or trailing edge surface may be only approximately twenty five percent (25%) exposed above the rotor drum 325. The extension or protrusion of the upper or leading edge 317 provides for increased efficiency of chipping and shredding of the material placed in contact with the rotor drum 325, as compared to a tool bit 301 that could be positioned in a standard non-angled pocket 315.

SUMMARY OF THE ACHIEVEMENT OF THE OBJECTS OF THE INVENTION

From the foregoing, it is readily apparent that I have invented an improved drum-type grinder having tool bits

101, 201, 251, 271, 301 that efficiently reduce waste material into small pieces, that reduce the power requirements of a drum-type grinder, and that can handle a wide variety of waste material including materials other than wood. The tool bits preferably have a concave shaped channel in the exterior surface of each side of the upper portion of the tool bit, forming a self-sharpening sharp edge on the upper portion of the bit opposite the base of the bit. As the plurality of protruding bits are placed into contact with material to be chipped and shredded, the sharp edges of each bit contact the material, and the rotating motion of the rotor along with the concave shape of the bit walls provides a self-sharpening action on the sharp edges of each bit, thereby increasing the operating life of each tool bit and reducing grinder operational costs due to down-time and bit replacement costs during replacement periods to replace dull tool bits. The improved cutting bits with concave shaped walls also provide a lesser need for power for operating of the rotor drum and provide a lower noise level during operation of the cutting bits and rotating drum. Reduction in power usage of approximately thirty percent (30%) has been observed in operating units and reduction in noise levels from approximately one hundred twenty (120) decibels to a reduced level of approximately eighty (80) decibels for the cutting bits with curved side walls and self-sharpening cutting edges.

It is to be understood that the foregoing description and specific embodiments are merely illustrative of the best mode of the invention and the principles thereof, and that various modifications and additions may be made to the apparatus by those skilled in the art, without departing from the spirit and scope of this invention, which is therefore understood to be limited only by the scope of the appended claims.

What is claimed is:

1. A grinder for chipping and shredding material into waste chips, comprising:

a housing, said housing having an interior chipping chamber;

a hopper, said hopper attachable to said housing, said hopper having an entrance through said housing into said chipping chamber;

a generally cylindrical drum, said drum having an axle positioned transverse within said housing, said drum having an exterior surface, said exterior surface partially exposed to said chipping chamber, said drum rotatable around said transverse positioned axle;

a screen positioned around said rotatable drum, said screen partially encircling said exterior surface that is exposed to said chipping chamber, said screen having variable sized openings for movement of chips through the screen, said screen being capable of holding chips near said exterior surface of said rotatable drum;

a plurality of pockets formed in said exterior surface of said drum;

a plurality of bits removably positioned in said plurality of pockets, each of said plurality of bits having a lead edge and a base, each of said bits having a lead wall extending arcuately from said lead edge to said base, said plurality of bits providing repetitive chipping and shredding of any material held by said screen due to said variable sized openings of the screen;

said plurality of pockets being angled such that said plurality of bits are off-set with respect to the radius of said drum, said lead edge of each of said off-set bits extending outward from said exterior surface.

2. The grinder of claim 1, wherein each bit of said plurality of bits further comprises:

a generally square base, said base securable in one of said plurality of pockets;

a wall extending from said base, said wall having an exterior leading surface and an exterior trailing surface, said exterior leading surface connected to said lead edge, said lead edge oriented in the direction of rotation of said cylindrical drum; and a concave channel formed in said exterior leading surface and said exterior trailing surface;

wherein said concave channel and said exterior leading surface are connected to said lead edge, said lead edge is placed in contact with said chipping and shredding material by the rotational movement of the exterior surface of said rotatable drum.

3. The grinder of claim 1, wherein each bit of said plurality of bits further comprises:

a generally polygon base having inwardly concave sides, said base of said bit securable in one of said plurality of pockets;

an upper portion of said base, said upper portion forming a continuous wall having a surface curving upward and outward in an arcuate shape from said base;

wherein said upper portion of said base of said bit extends out of one of said plurality of pockets, each lead edge is placed in contact with said chipping and shredding material by the movement of the exterior surface of said rotatable drum.

4. The grinder of claim 1, said plurality of bits each further comprising:

a base having at least five sides, said base of each bit securable in one of said plurality of pockets;

a wall extending from said base, said wall having at least five exterior side surfaces, each of said at least five exterior surfaces being curved upward and outward from said base;

at least one leading edge of one of said at least five exterior side surfaces; and at least one trailing edge opposite said at least one leading edge wherein said at least one leading edge is placed in contact with said chipping and shredding material by the movement of the exterior surface of said rotatable drum.

5. A cutting bit for chipping and shredding material by a waste grinder drum comprising:

a base, said base of said bit securable on said waste grinder drum;

a wall extending from said base, said wall having an exterior leading surface, an exterior trailing surface, and exterior side walls;

a lead edge of said exterior leading surface, said lead edge oriented opposite said base; and a concave channel formed in said exterior leading surface and said exterior trailing surface;

wherein said concave channel and said exterior leading surface are connected at said lead edge, said lead edge is placed in contact with said material for chipping and shredding of said material.

6. The cutting bit of claim 5, wherein said base is a generally polygon base, said exterior leading surface, said exterior trailing surface, and said exterior side walls curve upward and outward from said base.

7. The cutting bit of claim 5, wherein said base has at least five sides, each side having inwardly concave sides, and said wall having a continuous upper portion with a surface curving upward and outward in an arcuate shape from said base.

8. A cutting bit for chipping and shredding material by a waste grinder drum comprising:

a generally polygon base, said base of each bit securable on said waste grinder drum;

a wall extending from said base, said wall having at least one exterior leading surface, at least one exterior trailing surface, and exterior side surfaces, each of said exterior surfaces are curved upward and outward to cutting edges opposite from said base; and a trailing edge on said at least one curved exterior trailing surface;

wherein said at least one curved exterior leading surface is connected to said cutting edges, at least one of said cutting edges is placed in contact with material for chipping and shredding of said material.

9. A method of chipping and shredding material into waste comprising the steps of:

(a) providing a grinder, said grinder having a rotating cylindrical drum within said grinder, said providing step including providing a screen partially encircling an exterior surface of said rotating cylindrical drum, said screen having variable sized openings therethrouqh;

(b) placing material for chipping and shredding into said grinder;

(c) rotating said cylindrical drum, said drum having an exterior surface, said exterior surface including a plurality of bits having self-sharpening grinding edges;

(d) contacting said plurality of bits having self-sharpening edges with said material in said grinder, said self-sharpening grinding edges providing a leading grinding edge contacting said material;

(e) grinding said material with repeating contact with said leading grinding edge of said plurality of bits, said bits having a concave side wall forming a grinding edge of each bit, said bits extending from said exterior surface; and (f) removing said chipped and shredded material from said grinding step from contact with said rotating drum, said removing step including moving of chipped and shredded material through said screen having variable sized openings.

10. The method of claim 9 wherein said step of grinding further comprises:

providing said plurality of bits having a generally polygon base, said base having exterior upper surfaces curved upward and outward from said base to said leading grinding edge; and maintaining said leading grinding edge in an extending position for contact with said material for chipping and shredding.

11. The method of claim 9 wherein said step of grinding further comprises:

providing said plurality of bits having at least five sided base, said base having exterior upper surfaces curved upward and outward from said base to said leading grinding edge; and maintaining said leading grinding edge in an extending position for contact with said material for chipping and shredding.

12. The method of claim 9 wherein said step of grinding further comprises:

providing said plurality of bits having a generally polygon base having inwardly concave sides, said base having walls curving upward and outward from said base to said leading grinding edge; and maintaining said leading grinding edge in an extending position for contact with said material for chipping and shredding.

13. A grinder for chipping and shredding material into waste chips, comprising:

a housing, said housing having an interior chipping chamber;

a hopper, said hopper attachable to said housing, said hopper having an entrance through said housing into said chipping chamber;

a generally cylindrical drum, said drum having an axle positioned transverse within said housing, said drum having an exterior surface partially exposed to said chipping chamber, said drum being rotatable on said transverse positioned axle;

a screen positioned around said rotatable drum, said screen partially encircling said exterior surface that is exposed to said chipping chamber, said screen having variable sized openings for allowing movement of chips through the screen, said screen holds material near said exterior surface of said rotatable drum;

a plurality of pockets formed in said exterior surface of said drum; and a plurality of bits removably positioned in said plurality of pockets, each of said bits having a lead edge, each bit of said plurality of bits comprising:

a generally square base, said base being securable in one of said plurality of pockets;

a wall extending from said base, said wall having an exterior leading surface and an exterior trailing surface, said exterior leading surface connected to said lead edge, said lead edge oriented in the direction of rotation of said cylindrical drum; and a concave channel formed in said exterior leading surface and said exterior trailing surface;

wherein said concave channel and said exterior leading surface are connected to said lead edge, said lead edge is placed in contact with said chipping and shredding material by the rotational movement of the exterior surface of said rotatable drum; and wherein said plurality of pockets are angled so that said plurality of bits are off-set with respect to the radius of said drum, and said lead edge of each of said off-set bits extends outwardly from said exterior surface.

14. The grinder of claim 13, wherein each bit of said plurality of bits further comprises:

a generally polygon base having inwardly concave sides, said base of said bit securable in one of said plurality of pockets;

an upper portion of said base, said upper portion forming a continuous wall having a surface curving upward and outward in an arcuate shape from said base;

wherein said upper portion of said base of said bit extends out of one of said plurality of pockets, each lead edge is placed in contact with said chipping and shredding material by the movement of the exterior surface of said rotatable drum.

15. The grinder of claim 13, said plurality of bits each further comprising:

a base having at least five sides, said base of each bit securable in one of said plurality of pockets;

a wall extending from said base, said wall having at least five exterior side surfaces, each of said at least five exterior surfaces being curved upward and outward from said base;

at least one leading edge of one of said at least five exterior side surfaces; and at least one trailing edge opposite said at least one leading edge wherein said at least one leading edge is placed in contact with said chipping and shredding material by the movement of the exterior surface of said rotatable drum.

16. A method of chipping and shredding material into waste comprising the steps of:

(a) providing a grinder, said grinder having a rotating cylindrical drum within said grinder, said providing step including providing a screen partially encircling an exterior surface of said rotating cylindrical drum, said screen having variable sized openings therethrough, said screen does not enclose an exposed area of said rotating cylindrical drum within said grinder;

(b) placing material for chipping and shredding into said grinder, said placing step directing material toward said exposed area of said rotating cylindrical drum;

(c) rotating said cylindrical drum, said drum having an exterior surface, said exterior surface including a plurality of bits having self-sharpening leading grinding edges;

(d) providing said plurality of bits having a generally polygon base, said base having exterior upper surfaces curved upward and outward as a concave side wall of each bit extending from said base to said leading grinding edge;

(e) maintaining said leading grinding edge in an extending position for contact with said material for chipping and shredding;

(f) contacting said plurality of bits having self-sharpening grinding edges with said material in said grinder, said self-sharpening grinding edges providing a leading grinding edge contacting said material in a repetitive manner as said screen holds material near said exterior surface of said rotating cylindrical drum;

(g) grinding said material with repeating contact of said material with said leading grinding edge; and (h) removing said chipped and shredded material from said grinding step from contact with said rotating drum, said removing step including moving of chipped and shredded material through said screen having variable sized openings.

17. The method of claim 16, wherein said step of grinding further comprises:

providing said plurality of bits having at least five sided base, said base having exterior upper surfaces curved upward and outward from said base to said leading grinding edge; and maintaining said leading grinding edge in an extending position for contact with said material for chipping and shredding.

18. The method of claim 16, wherein said step of grinding further comprises:

providing said plurality of bits having a generally polygon base having inwardly concave sides, said base having walls curving upward and outward from said base to said leading grinding edge; and maintaining said leading grinding edge in an extending position for contact with said material for chipping and shredding.

* * * * *